US011331821B2

(12) United States Patent
Fischer et al.

(10) Patent No.: US 11,331,821 B2
(45) Date of Patent: May 17, 2022

(54) ELECTRICALLY DRIVEN DEVICE

(71) Applicant: Braun GmbH, Kronberg (DE)

(72) Inventors: Uwe Fischer, Darmstadt (DE); Johannes Stimpel, Wiesbaden (DE); Cirilo Javier Perez Lopez, Frankfurt am Main (DE); Andreas Erndt, Kelkheim (DE); Detlef Gleich, Friedrichsdorf (DE); Sebastian Hottenrott, Idstein (DE); Michael Steghaus, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 22 days.

(21) Appl. No.: 15/711,558

(22) Filed: Sep. 21, 2017

(65) Prior Publication Data

US 2018/0085950 A1 Mar. 29, 2018

(30) Foreign Application Priority Data

Sep. 28, 2016 (EP) ..... 16191091

(51) Int. Cl.
*B26B 19/28* (2006.01)
*B26B 19/06* (2006.01)
*B26B 19/38* (2006.01)

(52) U.S. Cl.
CPC ..... *B26B 19/288* (2013.01); *B26B 19/06* (2013.01); *B26B 19/28* (2013.01); *B26B 19/3866* (2013.01)

(58) Field of Classification Search
CPC ..... B26B 19/02; B26B 19/12; B26B 19/284; B26B 19/288; B26B 19/32; B26B 19/3866; B26B 19/06; B26B 19/28; A61C 17/3418; Y10T 74/1804
USPC ..... 30/43.92, 208–210, 215–219
See application file for complete search history.

(56) References Cited

U.S. PATENT DOCUMENTS 2,102,594 A * 12/1937 Hill ..... B26B 19/12 30/210
2,282,725 A * 5/1942 Jepson ..... B26B 19/12 30/43.9
2,364,162 A * 12/1944 Pasinski ..... B26B 19/28 30/43.9
3,261,092 A 7/1966 Martin
(Continued)

FOREIGN PATENT DOCUMENTS

AT 409604 B 9/2002
CH 270913 A 9/1950
(Continued)

OTHER PUBLICATIONS

DE1052266 translation (Year: 1955).*
(Continued)

*Primary Examiner* — Ghassem Alie
*Assistant Examiner* — Samuel A Davies
(74) *Attorney, Agent, or Firm* — Gerd Zetterer; Kevin C. Johnson

(57) ABSTRACT

An electric shaver with a drive shaft having a first rotary axis and a drive pin connected to the drive shaft eccentrically with respect to the rotary axis, and a driven shaft having a second rotary axis. The driven shaft is indirectly coupled to the drive shaft by a gear mechanism capable of converting a rotary motion of the drive shaft into a reciprocating motion of the driven shaft.

22 Claims, 5 Drawing Sheets

(56) References Cited

U.S. PATENT DOCUMENTS 3,274,631 A * 9/1966 Spohr ..... A61C 17/224 15/22.1
3,588,936 A * 6/1971 Duve ..... A61C 17/3472 15/22.1
3,589,005 A 6/1971 Friedrich et al.
3,748,371 A 7/1973 Krook et al.
3,749,951 A 7/1973 Artin et al.
3,800,172 A 3/1974 Artin et al.
4,030,573 A * 6/1977 Buzzi ..... A45D 29/14 188/380
4,065,977 A * 1/1978 Buzzi ..... B06B 1/10 30/42
4,114,264 A 9/1978 Buchholz
4,156,882 A 5/1979 Delagi et al.
4,167,060 A 9/1979 Sakamoto
4,292,737 A 10/1981 Packham
4,312,126 A 1/1982 Rochelt
4,428,117 A * 1/1984 Horii ..... B26B 19/04 30/43.7
4,570,499 A * 2/1986 Durr ..... F16H 21/18 74/44
4,631,825 A * 12/1986 Kuriyama ..... B26B 19/04 30/34.1
4,649,642 A * 3/1987 Nagasaki ..... B26B 19/06 30/34.1
4,660,283 A 4/1987 Yasunaka
4,700,476 A 10/1987 Locke et al.
4,797,997 A 1/1989 Packham et al.
4,827,615 A * 5/1989 Graham ..... B27B 19/006 30/166.3
4,930,217 A 6/1990 Wolf et al.
4,993,152 A 2/1991 Deubler
5,054,199 A * 10/1991 Ogawa ..... B26B 19/102 30/34.1
5,207,731 A 5/1993 Bukoschek
5,233,746 A 8/1993 Heintke
5,245,754 A 9/1993 Heintke et al.
5,257,456 A 11/1993 Franke et al.
5,325,590 A * 7/1994 Andis ..... B26B 19/28 30/216
5,381,576 A * 1/1995 Hwang ..... A61C 17/3481 15/22.1
5,398,412 A 3/1995 Tanahashi et al.
5,410,811 A 5/1995 Wolf et al.
5,542,179 A 8/1996 Beutel
5,564,191 A 10/1996 Ozawa
5,579,581 A 12/1996 Melton
5,606,799 A 3/1997 Melton
5,611,145 A 3/1997 Wetzel et al.
5,632,087 A 5/1997 Motohashi et al.
5,679,991 A 10/1997 Wolf
5,692,303 A 12/1997 Garenfeld et al.
5,704,126 A 1/1998 Franke et al.
5,715,601 A 2/1998 Nakatani et al.
5,745,995 A 5/1998 Yamashita et al.
5,784,743 A * 7/1998 Shek ..... A61C 17/3436 15/22.1
6,223,438 B1 5/2001 Parsonage et al.
6,226,871 B1 5/2001 Eichhorn et al.
6,301,786 B1 10/2001 Oswald et al.
6,317,984 B1 11/2001 Okabe
6,381,849 B2 5/2002 Eichhorn et al.
6,415,513 B1 7/2002 Eichhorn et al.
6,441,517 B1 * 8/2002 Brum ..... B26B 19/28 310/30
6,675,480 B2 1/2004 Oswald
6,931,731 B2 8/2005 Izumi et al.
7,020,966 B2 4/2006 Shiba et al.
7,162,801 B2 1/2007 Royle
7,171,751 B2 2/2007 Iwashita et al.
7,325,311 B2 * 2/2008 Shimizu ..... B26B 19/046 30/43.92
7,334,338 B2 2/2008 Shiba et al.
7,419,494 B2 9/2008 Hashiguchi et al.
7,841,090 B2 11/2010 Eichhorn et al.
8,464,429 B2 6/2013 Haczek et al.
8,555,510 B2 10/2013 Fuerst et al.
8,720,069 B2 * 5/2014 Iwashita ..... B26B 19/048 30/43.92
8,806,756 B2 8/2014 Kraus et al.
9,127,366 B2 9/2015 Matsuda et al.
9,399,302 B2 7/2016 Shimizu et al.
9,457,485 B2 10/2016 Pohl et al.
9,676,108 B2 6/2017 Beugels et al.
9,768,675 B2 9/2017 Andrikowich et al.
10,350,772 B2 7/2019 Fischer et al.
10,486,316 B2 11/2019 Erndt et al.
10,556,354 B2 2/2020 Erndt et al.
10,583,573 B2 3/2020 Erndt et al.
10,596,714 B2 3/2020 Peter et al.
10,618,186 B2 4/2020 Erndt et al.
2002/0108251 A1 * 8/2002 Brum ..... B26B 19/282 30/43.7
2002/0157257 A1 10/2002 Oswald
2002/0161380 A1 10/2002 Saitou et al.
2002/0175239 A1 11/2002 Momoi et al.
2003/0000031 A1 * 1/2003 Zhuan ..... A61C 17/3418 15/28
2004/0016068 A1 * 1/2004 Lee ..... A61C 17/3418 15/22.1
2004/0128778 A1 * 7/2004 Wong ..... A61C 17/34 15/22.1
2004/0231160 A1 11/2004 Shiba et al.
2004/0237310 A1 12/2004 Shiba et al.
2005/0199265 A1 * 9/2005 France ..... A46B 9/00 134/6
2006/0021228 A1 2/2006 Shiba et al.
2006/0085984 A1 4/2006 Oh
2006/0101598 A1 * 5/2006 Fujimoto ..... A61C 17/3445 15/22.2
2006/0143924 A1 7/2006 Mercurio
2006/0150420 A1 7/2006 Sinnema et al.
2007/0062042 A1 3/2007 Kleemann et al.
2008/0130169 A1 6/2008 Kitamura
2008/0134515 A1 6/2008 Sato et al.
2009/0025229 A1 1/2009 Kappes et al.
2009/0049694 A1 2/2009 Morris
2009/0056142 A1 3/2009 Royle et al.
2009/0133263 A1 5/2009 Eichhorn et al.
2009/0165305 A1 7/2009 Kraus et al.
2010/0175264 A1 7/2010 Shimizu et al.
2011/0094107 A1 4/2011 Ring et al.
2011/0099814 A1 5/2011 Fuerst et al.
2012/0017710 A1 * 1/2012 Kramp ..... A61C 17/3436 74/25
2012/0055025 A1 3/2012 Pohl et al.
2012/0060382 A1 3/2012 Beugels et al.
2012/0125699 A1 5/2012 Guthrie
2013/0304069 A1 * 11/2013 Bono ..... A61B 17/1624 606/80
2014/0054980 A1 2/2014 Andrikowich et al.
2014/0165406 A1 6/2014 Shimizu et al.
2014/0290452 A1 10/2014 Burghardt et al.
2015/0097322 A1 4/2015 Rarey et al.
2015/0249893 A1 9/2015 Broberg et al.
2016/0151922 A1 6/2016 Shimizu et al.
2016/0176059 A1 6/2016 Ring et al.
2016/0325444 A1 11/2016 Langsdorf et al.
2016/0327314 A1 11/2016 Langsdorf
2018/0085935 A1 3/2018 Erndt et al.
2018/0085939 A1 3/2018 Krauss et al.
2018/0085940 A1 3/2018 Krauss et al.
2018/0085941 A1 3/2018 Krauss et al.
2018/0085948 A1 3/2018 Krauss et al.
2018/0085951 A1 3/2018 Krauss et al.
2018/0085955 A1 3/2018 Krauss et al.
2018/0085956 A1 3/2018 Bady et al.
2018/0311841 A1 11/2018 Kraus et al.
2018/0311842 A1 11/2018 Kraus et al.

(56) References Cited

U.S. PATENT DOCUMENTS

| | | | |
|---|---|---|---|
| 2018/0319028 | A1 | 11/2018 | Kraus et al. |
| 2018/0333874 | A1 | 11/2018 | Shimizu et al. |

FOREIGN PATENT DOCUMENTS

| | | | | | |
|---|---|---|---|---|---|
| CN | 2094434 | U | | 1/1992 | |
| CN | 1127488 | A | | 7/1996 | |
| CN | 1145291 | A | | 3/1997 | |
| CN | 1225051 | A | | 8/1999 | |
| CN | 1310660 | A | | 8/2001 | |
| CN | 1727132 | A | | 2/2006 | |
| CN | 201235547 | Y | | 5/2009 | |
| CN | 101489738 | A | | 7/2009 | |
| CN | 101564846 | A | | 10/2009 | |
| CN | 101885185 | B | | 11/2010 | |
| CN | 102076469 | A | | 5/2011 | |
| CN | 102089127 | A | | 6/2011 | |
| CN | 102089127 | B | | 6/2011 | |
| CN | 102985236 | A | | 3/2013 | |
| CN | 103079779 | A | | 5/2013 | |
| CN | 204431302 | U | | 7/2015 | |
| CN | 206230555 | U | | 6/2017 | |
| DE | 1052266 | | | 11/1955 | |
| DE | 1052266 | B | * | 3/1959 | ..... B26B 19/10 |
| DE | 102006010323 | A1 | | 9/2007 | |
| EP | 0529406 | A1 | | 3/1993 | |
| EP | 618853 | B1 | | 3/1996 | |
| EP | 674979 | B1 | | 11/1997 | |
| EP | 1005404 | B1 | | 2/2002 | |
| EP | 1017546 | B1 | | 4/2003 | |
| EP | 1161325 | B1 | | 5/2003 | |
| EP | 1403011 | A1 | | 3/2004 | |
| EP | 1621299 | A1 | | 2/2006 | |
| EP | 1782986 | A1 | | 5/2007 | |
| EP | 1728603 | B1 | | 3/2008 | |
| EP | 2024147 | A1 | | 2/2009 | |
| EP | 1548917 | B1 | | 5/2010 | |
| EP | 2208589 | A1 | | 7/2010 | |
| EP | 2243604 | A2 | | 10/2010 | |
| EP | 2004364 | B1 | | 4/2011 | |
| EP | 1661672 | B1 | | 5/2011 | |
| EP | 2035195 | B1 | | 11/2011 | |
| EP | 2404716 | A1 | | 1/2012 | |
| EP | 2434626 | A2 | | 3/2012 | |
| EP | 2435218 | A1 | | 4/2012 | |
| EP | 2404715 | B1 | | 11/2012 | |
| EP | 3038242 | A1 | | 6/2016 | |
| FR | 1391957 | A | | 3/1965 | |
| FR | 2911083 | A1 | | 7/2008 | |
| GB | 811207 | A | | 4/1959 | |
| GB | 825851 | A | * | 12/1959 | ..... B26B 19/10 |
| GB | 2014372 | A | | 8/1979 | |
| GB | 2266070 | A | | 10/1993 | |
| JP | S531153 | A | | 1/1978 | |
| JP | 53089562 | A | | 8/1978 | |
| JP | 53115372 | A | * | 10/1978 | |
| JP | S54134754 | U | | 9/1979 | |
| JP | 54136974 | A | * | 10/1979 | |
| JP | H04231992 | A | | 8/1992 | |
| JP | H0584364 | A | | 4/1993 | |
| JP | H05084364 | A | | 4/1993 | |
| JP | 06054965 | A | | 3/1994 | |
| JP | 06233873 | A | | 8/1994 | |
| JP | 07185150 | A | | 7/1995 | |
| JP | 07508664 | A | | 9/1995 | |
| JP | 08066567 | A | | 3/1996 | |
| JP | H093852 | A | | 1/1997 | |
| JP | H0938352 | A | | 2/1997 | |
| JP | 09262378 | A | | 10/1997 | |
| JP | 10156066 | A | | 6/1998 | |
| JP | 10211369 | A | | 8/1998 | |
| JP | 2001503287 | A | | 3/2001 | |
| JP | 2002521164 | A | | 7/2002 | |
| JP | 2003125837 | A | | 5/2003 | |
| JP | 2003519553 | A | | 6/2003 | |
| JP | 2004049864 | A | | 2/2004 | |
| JP | 2006042898 | A | | 2/2006 | |
| JP | 2006149445 | A | | 6/2006 | |
| JP | 2006527052 | A | | 11/2006 | |
| JP | 2008515501 | A | | 5/2008 | |
| JP | 2009528863 | A | | 3/2009 | |
| JP | 2009-538104 | A | | 10/2009 | |
| JP | 2009254785 | A | | 11/2009 | |
| JP | 2010082204 | A | | 4/2010 | |
| JP | 4487650 | B2 | | 6/2010 | |
| JP | 2010148715 | A | | 7/2010 | |
| JP | 2010162135 | A | | 7/2010 | |
| JP | 2010252941 | A | | 11/2010 | |
| JP | 2011526168 | A | | 10/2011 | |
| JP | 2011527204 | A | | 10/2011 | |
| JP | 2012-016491 | A | | 1/2012 | |
| JP | 2013-066555 | A | | 4/2013 | |
| JP | 2013-070809 | A | | 4/2013 | |
| JP | 2013188455 | A | | 9/2013 | |
| JP | 2014204776 | A | | 10/2014 | |
| JP | 2015-146988 | A | | 8/2015 | |
| JP | 2015159872 | A | | 9/2015 | |
| JP | 2016077464 | A | | 5/2016 | |
| JP | 2017-127394 | A | | 7/2017 | |
| RU | 2175911 | C1 | | 11/2001 | |
| WO | 9801264 | A2 | | 1/1998 | |
| WO | 03026854 | A1 | | 4/2003 | |
| WO | 03103905 | A1 | | 12/2003 | |
| WO | 2008009322 | A1 | | 1/2008 | |
| WO | 2009129667 | A1 | | 10/2009 | |
| WO | 2010003603 | A1 | | 1/2010 | |
| WO | 2013095165 | A1 | | 6/2013 | |

OTHER PUBLICATIONS

Official Notice of Rejection; Japanese Patent Application No. 2019-515931; dated Apr. 13, 2020; Japanese Patent Office.

European Search Report; European Application No. 16191091; dated Mar. 14, 2017; European Patent Office; Munich, Germany.

China First Search; China Application No. 2017800599077; dated Apr. 22, 2020; National Intellectual Property Administration, PRC.

Written Opinion and International Search Report; International Application No. PCT/IB2017/055934; dated Apr. 5, 2018; European Patent Office; Munich, Germany.

European Search Report; European Application No. 161910093; Mar. 13, 2017; European Patent Office; Munich, Germany.

China First Search; China Application No. 2017800599185; dated Apr. 27, 2020; National Intellectual Property Administration, PRC.

Japan Search Report; Japan Application No. 2019-515608; dated Apr. 22, 2020; Japan Patent Office; Tokyo, Japan.

Written Opinion and International Search Report; International Application No. PCT/IB2017/055923; dated Apr. 5, 2018; European Patent Office; Munich, Germany.

European Search Report; European Application No. 16191099; dated Mar. 28, 2017; European Patent Office; Munich, Germany.

China First Search; China Application No. 2017800599202; dated May 6, 2020; National Intellectual Property Administration, PRC.

Written Opinion and International Search Report; International Application No. PCT/IB2017/055853; dated Apr. 5, 2018; European Patent Office; Munich, Germany.

European Search Report; European Application No. 116191103; dated Mar. 28, 2017; European Patent Office; Munich, Germany.

China First Search; China Application No. 2017800599024; dated Apr. 3, 2020; National Intellectual Property Administration, PRC.

Written Opinion and International Search Report; International Application No. PCT/IB2017/055933; dated Apr. 5, 2018; European Patent Office; Munich, Germany.

European Search Report; European Application No. 17193261; dated Mar. 7, 2018; European Patent Office; Munich, Germany.

China First Search; China Application No. 2017800598943; dated Apr. 3, 2020; National Intellectual Property Administration, PRC.

Written Opinion and International Search Report; International Application No. PCT/IB2017/055935; dated Apr. 5, 2018; European Patent Office; Munich, Germany.

(56) References Cited

OTHER PUBLICATIONS

European Search Report; European Application No. 16191097; dated May 17, 2017; European Patent Office; Munich, Germany.
European Partial Search Report; European Application No. 16191097; dated Mar. 15, 2017; European Patent Office; Munich, Germany.
China First Search; China Application No. 2017800590903; dated Apr. 26, 2020; National Intellectual Property Administration, PRC.
Written Opinion and International Search Report; International Application No. PCT/IB2017/055926; dated Apr. 6, 2018; European Patent Office; Munich, Germany.
European Search Report; European Application No. 16191106; dated May 17, 2017; European Patent Office; Munich, Germany.
China First Search; China Application No. 2017800599166; dated May 9, 2020; National Intellectual Property Administration, PRC.
Written Opinion and International Search Report; International Application No. PCT/IB2017/055862; dated Apr. 5, 2018; European Patent Office; Munich, Germany.
European Search Opinion and Report; EP Application No. 17168469.9; dated Oct. 27, 2017; European Patent Office.
European Search Opinion and Report; EP Application No. 17168473.1; dated Nov. 9, 2017; European Patent Office.
European Search Opinion and Report; EP Application No. 17168474.9; dated Nov. 8, 2017; European Patent Office.
Written Opinion of the International Searching Authority; International Application No. PCT/IB2018/0052506; dated Nov. 1, 2018; European Patent Office; Munich, Germany.
Written Opinion of the International Searching Authority; International Application No. PCT/IB2018/052502; dated Nov. 1, 2018; European Patent Office; Munich, Germany.
Written Opinion of the International Searching Authority; International Application No. PCT/IB2018/052503; dated Nov. 1, 2018; European Patent Office; Munich, Germany.
Written Opinion of the International Searching Authority; International Application No. PCT/IB2018/052507; dated Nov. 1, 2018; European Patent Office; Munich, Germany.
https://www.stainless-steel-world.net/basicfacts/stainless-steel-and-its-families.html; Accessed Sep. 26, 2019 (Year: 2019).
https://en.wikipedia.org/wiki/Mu-metal; Accessed Sep. 26, 2019 (Year: 2019).
Supplemental Search Report dated Apr. 6, 2021; Chinese Application No. 2017800599166; The State Intellectual Property Office of People's Republic of China.

* cited by examiner

ELECTRICALLY DRIVEN DEVICE

FIELD OF THE INVENTION

The present invention is concerned with an electrically driven device, for example an electric hair removal device, such as a shaver.

BACKGROUND OF THE INVENTION

EP 2 024 147 B1 discloses an electric shaver comprising a housing, an electric motor mounted in the housing and comprising a drive shaft having a first rotary axis, a drive pin connected to the drive shaft eccentrically with respect to the rotary axis, and at least one driven shaft having a second rotary axis and mounted in the housing for performing a movement relative to the housing. The driven shaft is indirectly coupled to the drive shaft by means of a gear mechanism converting a rotary motion of the drive shaft into a reciprocating motion of the driven shaft. The driven shaft is coupled to a cutter element of the shaver. The gear mechanism comprises a swing bridge. A further electric shaver comprising a gear mechanism with a swing bridge is known from U.S. Pat. No. 4,167,060.

Further dry shavers are provided with a motor in a body portion of the housing, a drive-train arranged in the body and drive pins arranged relative to the body combined with a shaver head that is flexibly connected to the body. Typically the transfer of the rotation of the eccentric drive pin of the motor into a lateral or linear movement is realized via a so called "oscillating bridge", a combination of a four bar joint mechanism with a groove where the eccentric of the motor is rotating in. The oscillating bridge transfers rotation into linear oscillation, transmits the mechanical energy of the motor to the head with the cutting elements and provides a spring load to the drive system that improves the energy balance of the dynamic system. Relative movements of the head towards the components arranged in the body and angled head to body arrangements may cause restrictions for the efficient and effective flow of forces from the motor to the head and the cutting elements. Further, this may cause unwanted friction, noise, wear and tear, technical complexity which comes along with cost and installation space requirements resulting in a bulky head design. At the same time these type of drive systems tend to be soft in their mechanical power transmission properties, e.g. the output value of deflection divided through the input value of deflection results in values lower 0,9 (effectiveness<0,9). The value for effectiveness in known solutions is significantly affected by the product architecture of a shaver, and there in particular via the inclination of the head towards the body.

As angled product architectures make the power flow go around the corner, the known solutions either connect the motor with the head, which results in bulky and misbalanced heads, or implement the motor in an inclined position relative to the body, which results in bulky bodies or complicated inner product architecture, or the inclination is compensated in an oscillating bridge, which typically results in a bulky handle or in reduced effectiveness of the transmission.

It is an object of the present disclosure to provide an electrically driven device permitting more flexibility regarding the design of the device. It is a further object to reduce the force or torque required to drive the driven shaft and/or to reduce sound emissions and wear.

SUMMARY OF THE INVENTION

In accordance with one aspect there is provided an electrically driven device comprising a housing, an electric motor mounted in the housing and comprising a drive shaft having a first rotary axis, a drive pin connected to the drive shaft eccentrically with respect to the rotary axis, and a driven shaft having a second axis and mounted in the housing for performing a motor driven movement relative to the housing. The driven shaft may be indirectly, i.e. via another component part, coupled to the drive shaft by means of a gear mechanism converting a rotary motion of the drive shaft into a reciprocating motion of the at least one driven shaft. The gear mechanism may comprise a floating bearing coupled to the drive pin, an intermediate shaft pivotably mounted in the housing and a crank arm coupling the intermediate shaft to the floating bearing thereby converting a rotary motion of the drive shaft into a reciprocating pivoting of the intermediate shaft about a second rotary axis which extends in the longitudinal direction of the intermediate shaft. The gear mechanism further comprises at least one elastically deformable element coupled (directly or indirectly) to the housing and coupled (directly or indirectly) to e.g. the floating bearing, the intermediate shaft and/or the crank arm. The intermediate shaft may be coupled to the at least one driven shaft by means of a pivotable bridge such that the at least one driven shaft is offset with respect to the intermediate shaft. The coupling between the intermediate shaft and the at least one driven shaft transfers a force, a torque and/or at least one movement but may permit relative movement in another direction, e.g. plunging or rotation of the at least one driven shaft with respect to the intermediate shaft. The electrically driven device may be an electric shaver with the at least one driven shaft coupled to a cutter unit of the shaver. That is, the driven shaft may be adapted and arranged for driving a functional element of the device, like one or more cutter units. For example, the at least one driven shaft may be coupled to a non-foil type cutter element which is guided in a shaver head permitting a linear translational movement of the non-foil type cutter element within the shaver head.

According to a further aspect of the present disclosure, an electric shaver may comprise a shaver body housing, a shaving head housing that is connected to the shaver housing and which carries at least two shaving sub-assemblies with linearly movable cutting elements, a motor with a rotating shaft located in the shaver body housing, a gear mechanism converting a continuous rotation from the motor to an oscillating rotating movement and transferring said oscillating rotating movement to a single oscillating rotating intermediate shaft, with said intermediate shaft transferring the said movement from the shaver body housing to the shaver head, and a distributer plate transmitting the reciprocating rotating movement of the single oscillating intermediate shaft to the cutting elements. Preferably, said gear mechanism may be located close to the motor and said distributer plate may be located close to the cutting elements with said intermediate shaft connecting one or more component parts of the gear mechanism and the distributor plate.

The gear mechanism may comprise a scotch yoke mechanism, i.e. a slotted link mechanism, converting a rotary motion of the drive shaft into a reciprocating pivoting motion of the intermediate shaft.

DETAILED DESCRIPTION OF THE INVENTION

Figure 1:
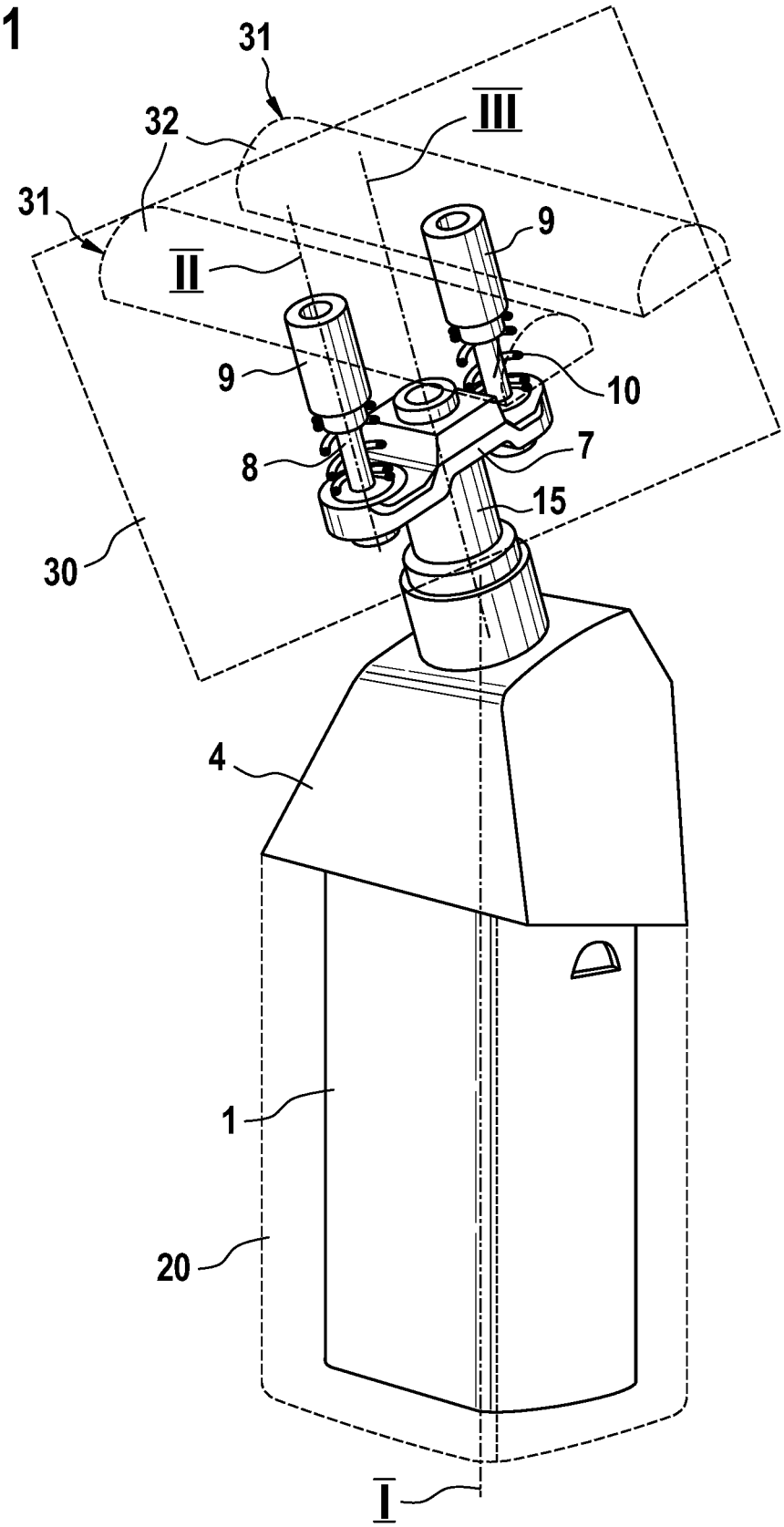
FIG. 1 shows a partial perspective view of a device according to a first embodiment.
Figure 2:
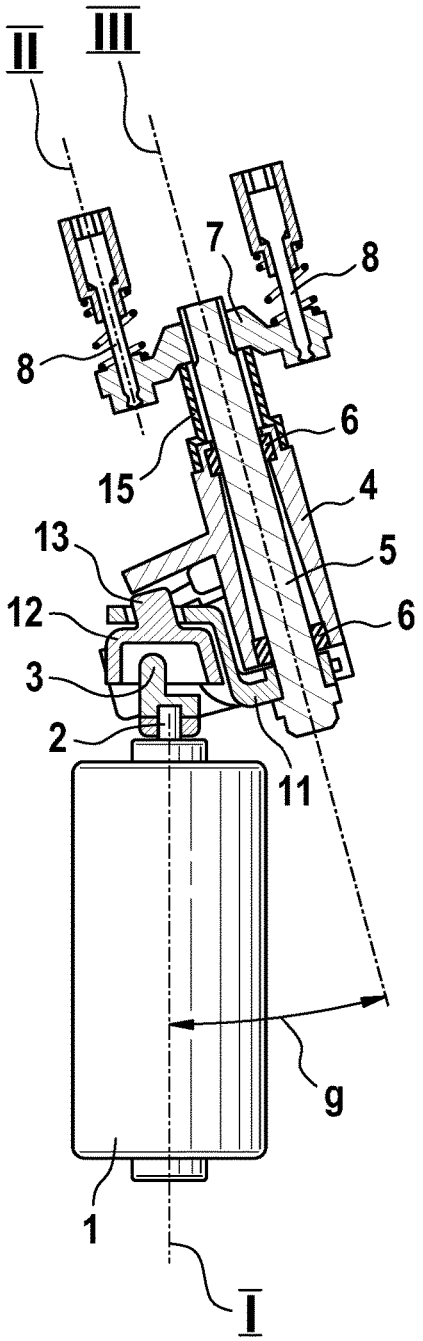
FIG. 2 shows a sectional view of the device of FIG. 1.

The at least one elastically deformable element may be arranged such that the floating bearing and/or the crank arm is biased by the at least one elastically deformable element into a neutral position or center position. In this neutral position, the at least one elastically deformable element is preferably unstressed. In other words, energy is stored in the at least one elastically deformable element if the at least one elastically deformable element is deflected from the neutral position. On the other hand, energy is released from the at least one elastically deformable element as the floating bearing is moved towards this neutral position. During dynamic operation of the system comprising motor, gear mechanism, drive shaft and movable cutting elements this may decelerate this may decelerate the gear mechanism as the floating bearing moves away from the neutral position and/or may accelerate the gear mechanism as the floating bearing returns to the neutral position which disburdens the motor at the turning points (dead points) of the reciprocating movement of the intermediate shaft, i.e. it reduces the force or torque required to drive the driven shaft when the motor is in rotation. In addition, with the reversal of the movement of the crank arm, the intermediate shaft and the bridge being e.g. somewhat cushioned or less abrupt, this contributes to reducing sound emissions and wear.

The neutral or center position may be defined by the intermediate shaft and the drive pin being located in a common plane. Typically, in the neutral or center position, the orientation of the crank arm may be predominantly extending in this plane, too. That is, in the neutral or center position, the drive pin is in one of its turning points (dead points) relative to the floating bearing. With the motor and the drive pin performing one full rotation, the floating bearing passes the neutral position twice with the drive pin being in 180° spaced positions.

The at least one driven shaft is indirectly mounted in the housing by means of the intermediate shaft and the pivoting bridge which may carry of the at least one driven shaft. The intermediate shaft may be guided within the housing or a component part constrained to the housing, for example a frame or the like, thereby in directly guiding the at least one driven shaft via the pivotable bridge which couples the at least one driven shaft to the intermediate shaft.

The elastically deformable element may be a spring, for example a compression spring or a tension spring. In accordance with one aspect, the at least one elastically deformable element comprises two elastically deformable levers guiding the floating bearing on a path. For example, the levers may be arranged substantially parallel with each other, i.e. like a parallelogram. The elastically deformable levers may be leaf springs, for example with a high stiffness in a direction parallel to the first rotary axis and a lower stiffness in a direction substantially perpendicular to the first rotary axis. Further, the at least one leaf spring may comprise at least one tapered section with a reduced bending stiffness. In other words, the levers or the like may be tailored to be elastically deformable in a way allowing guiding of the floating bearing and at the same time storing energy upon deflection from the neutral position.

The at least one elastically deformable element coupled to the floating bearing has the effect that movement of the floating bearing caused by rotation of the eccentric drive pin periodically strains the elastically deformable element. With the floating bearing oscillating back and forth energy is stored in the elastically deformable element and released from the elastically deformable element depending on the angular position of the eccentric drive pin. If the electrically driven device is a shaver with cutter units reciprocating linearly the elastically deformable elements may be arranged such that energy is stored in the elastically deformable elements as the cutter units approach one of their turning points and such that energy is released if the cutter units are at or shortly behind their turning point. In other words, the elastically deformable elements decelerate the cutter units at the end of their linear movement in a first direction and accelerate the cutter units in a second, opposite direction. This contributes in reducing noise generated by the back and forth movement of the cutter units. In addition, the force or torque applied by the motor for driving the cutter units may be reduced. This may result in smaller motors and reduced energy consumption. Further, this may contribute in reducing wear.

In one arrangement the at least one elastically deformable element forms a unitary component part with the floating bearing, i.e. the at least one elastically deformable element and the floating bearing are made integrally as one piece. For example, the floating bearing and the elastically deformable element may be injection molded using an elastically deformable plastic material. In more detail, the floating bearing may comprise a slotted hole provided in a central portion bridging two elastically deformable levers of the at least one elastically deformable element.

The crank arm may be rotationally and axially constrained to the intermediate shaft. This increases dynamic stiffness of the gear mechanism. The crank arm and the intermediate shaft may be separate component parts or may be a single, unitary component part. Further, the intermediate shaft may be rotationally and axially constrained to the pivotable bridge. Again, the intermediate shaft and the pivotable bridge may be separate component parts or may be a single, unitary component part.

The intermediate shaft may be externally guided in the housing, e.g. by means of at least one bearing sleeve. As an alternative, the intermediate shaft may be a hollow shaft internally guided on a bearing pin.

The crank arm may be coupled to the floating bearing by means of a pin engaging a recess or hole. For example, the crank arm may be provided with a hole, e.g. a slotted hole, which is engaged by a pin provided on the floating bearing.

The first rotary axis may be inclined with respect to the second rotary axis. In more detail, the eccentric drive pin may extend parallel to the first rotary axis and the intermediate shaft and the at least one driven shaft may extend parallel to the second rotary axis. With the electrically driven device being an electric shaver this arrangement permits to provide the shaver head inclined or angled with respect to the shaver body. In addition, the gear mechanism with the intermediate shaft allows a design of a shaver or the like device with a constricted neck between a body portion and a head portion.

The pivotable bridge may be rotationally constrained to the at least one driven shaft. The at least one driven shaft and the pivotable bridge may be separate component parts or may alternatively form one single unitary component part. As a further alternative, the at least one driven shaft may be rotatable with respect to the pivotable bridge. Due to the arrangement of the at least one driven shaft on the pivotable bridge, a reciprocating pivoting of the pivotable bridge results in a back and forth movement of the at least one driven shaft. This back and forth movement of the at least one driven shaft is a movement on the circular path which is close to a linear movement.

The housing of the electrically driven device may comprise a bearing insert or bearing portion with the intermediate shaft extending through the bearing insert. A sealing may be provided between the bearing insert and the intermediate shaft. Taking into account that the intermediate shaft performs a reciprocating pivoting movement by a small angle, for example about 6°, the ceiling may comprise an elastically deformable sleeve fixed to the bearing insert and to the intermediate shaft. Such a sealing may contribute in closing off the housing or body portion of a shaver while a detachable shaver head may have to be cleaned in a cleaning liquid. In other words, the proposed device further improves sealing between different portions of the device, e.g. a shaver body and a shaver head. For example, a sealing separating an inner sealed compartment of the motor and elements of the transmission (body) with an outer unsealed area where the cutting parts and/or the shaving cartridge is located.

For example, the housing comprises a shaver body (handle) and an, e.g. detachable, shaver head. A neck portion may be arranged interposed between the shaver body and the shaver head. The electric motor, the drive shaft, the drive pin, the crank arm, the at least one elastically deformable element and the floating bearing may be located in the shaver body. Further, the at least one driven shaft and the pivotable bridge may be located in the shaver head. The intermediate shaft may extend through the neck portion and partially in the shaver body and partially in the shaver head.

The at least one driven shaft of the electrically driven device may be coupled to a cutter unit, for example a lower, non-foil type cutter block reciprocating with respect to the fixed file type upper cutter member.

Preferably, the gear mechanism converts a continuous rotary motion of the drive shaft into an at least substantially sinusoidal reciprocating displacement driven shaft.

The proposed solution transfers and transmits the continuous rotation of an electric motor via a single oscillatory rotating transmission shaft, namely the intermediate shaft, to an arrangement of one or more, typically two or more, cutting elements which perform an oscillatory linear counteracting movement.

Further, the drive system with the gear mechanism may provide for an angled arrangement of the electric motor main axis, i.e. the first rotary axis, relative to the intermediate transmission shaft, which allows an easy installation of the drive system into shaver-architectures which have an angled head. The proposed device is effective by having no or merely a low loss of movement and efficient by having a low loss of energy even though the distance between the power input, i.e. the eccentric drive pin of the motor, and the power output, i.e. the driven shaft which may be a drive pin of a cutter unit, is relatively long.

The device provides a drive-train which may be at least partially arranged in the body/handle to drive the cutting elements of a shaver arranged in a flexible and angled shaver head without the drawbacks of known devices. For example, the use of the intermediate shaft to transfer the mechanical power via an oscillatory rotating pin from the shaver body to the shaver head makes the stiffness of the transmission system independent of the distance between the motor and the cutting parts, while the stiffness of the transmission system, e.g. less than 0.1 mm/1000 rpm, is superior to known designs having a dynamical stiffness of e.g. 0.2 mm/1000 rpm. In addition, the angle between a shaver head and a shaver body is not resulting in a loss of effectiveness of the drive system.

Turning now to the first exemplary embodiment depicted in FIGS. 1 to 7, the electrically driven device, which may be an electric shaver, comprises a motor 1 with a drive shaft 2 having a first rotary axis I. A shaver head 30 and a shaver handle (shaver body) 20 are schematically depicted partly by dashed lines. The drive shaft 2 is operably connected to an eccentric drive pin 3. The eccentric drive pin 3 may be directly connected to the drive shaft 2 or may be indirectly connected to the drive shaft 2, e.g. by means of one or more interposed elements and/or a gear. For example, in an alternative arrangement a pinion is provided on the drive shaft 2 meshing with a ring gear which in turn carries the drive pin 3. The gear ratio between the drive shaft 2 and the drive pin 3 may be adapted as required, e.g. depending from the torque and/or voltage of the motor 1.

A housing of the device is mainly omitted in the depicted embodiment to increase visibility auf the interior component parts. The housing may be a single component part or may comprise several component parts which are, preferably permanently, attached to each other. In the present embodiment, the housing is a multicomponent housing comprising a bearing insert 4. The housing bearing insert 4 may be part of a shaver body housing which may be coupled to a shaver head housing.

An intermediate shaft 5 is rotatably guided within bearing insert 4 by means of bearing sleeves 6. A bridge 7 is rotationally constrained to the intermediate shaft 5. In the embodiment depicted in the Figures, the bridge 7 is attached with a central portion to the intermediate shaft 5 with two arms extending in opposite directions off the bridge. Each of these opposite arms of the bridge 7 carries a driven shaft 8 defining a second rotary axis II. The intermediate shaft 5 extends along a third rotary axis III which may be parallel to the second rotary axis II. In the embodiment depicted in the Figures the first rotary axis I is inclined with respect to the second rotary axis II and the third rotary axis III. For example, the third rotary axis III may extend in a common plane with the first rotary axis I or in a plane parallel to the plane in which the first rotary axis I extends. The inclination g of the third rotary axis III with respect to the first rotary axis I may be less than g=60°, e.g. between g=10° and 35° and more preferably about g=25°. Although an exemplary inclination of about g=40° to about 50° is depicted in the Figures, a different inclination or no inclination may be chosen.

For example, the driven shaft 8 may be axially and rotationally constrained to the bridge 7. Each of the driven shafts 8 may be provided with a bearing sleeve 9 which in turn may be coupled to a cutter unit (not shown). The bearing sleeves 9 may be rotatable with respect to the respective driven shaft 8 and may be axially displaceable with respect to the driven shaft 8 against the bias of a spring 10. In the embodiment depicted in FIGS. 1 and 2, two driven shafts 8 are shown. However, bridge 7 may be provided with only one single driven shaft or more than two driven shafts, for example three driven shafts 8. The driven shafts 8 and the bearing sleeves 9 each are coupled with a blade type lower cutter 31 which reciprocates linearly relative to a foil type upper cutter 32 (both are schematically depicted partly by dashed lines in FIG. 1). The invention is not limited to a specific number of hair cutting units within the shaver head 30 or the type of hair cutting units coupled with the driven shafts 8.

Figure 3:
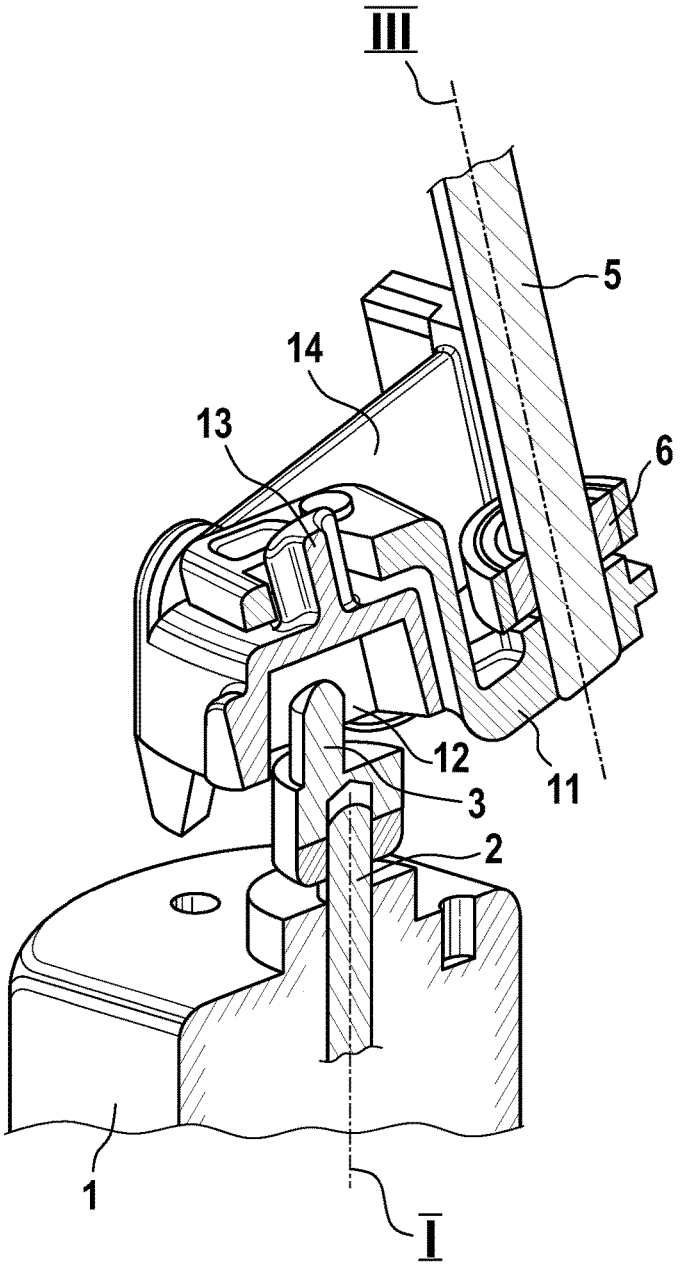
FIG. 3 shows a perspective sectional view of a detail of the device of FIG. 1.
Figure 4:
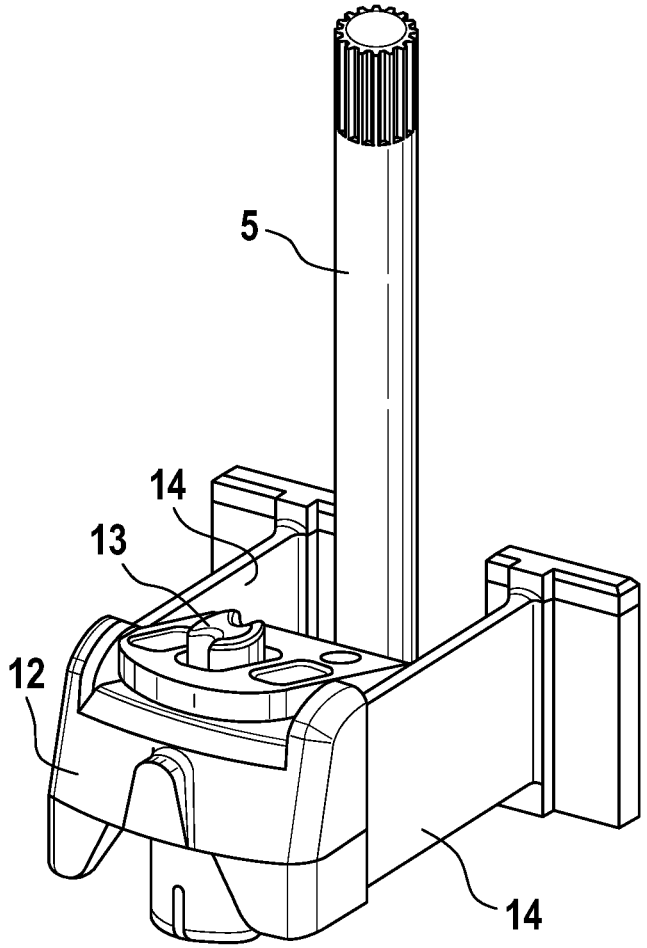
FIG. 4 shows a perspective view of component parts of the device of FIG. 1.
Figure 5:
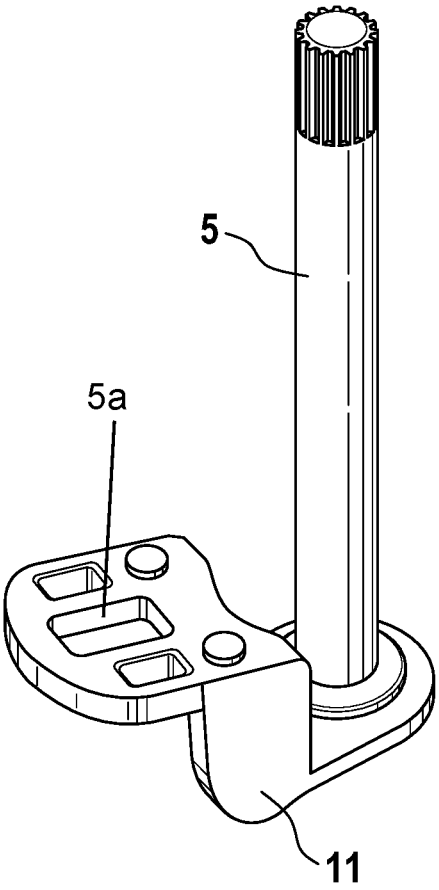
FIG. 5 shows a further perspective view of component parts of the device of FIG. 1.

The intermediate shaft 5 is coupled to the drive pin 3 by means of a crank arm 11 which is rotationally constrained to the intermediate shaft 5. The crank arm 11 in turn is coupled to the drive pin 3 by means of a floating bearing 12. The floating bearing 12 is a component part provided with a slotted hole or slot-like recess (R) as shown in FIGS. 3 and 6. The floating bearing 12 is provided with a pin 13 engaging an, e.g. slotted, hole or recess 12*a* of the crank arm 11 (cf FIG. 5).

The floating bearing 12 is guided in the housing, e.g. in bearing insert 4, by means of two elastically deformable levers 14 which are provided as a unitary component part with the floating bearing 12. As an alternative, the floating bearing 12 may be a separate component part fixed or attached to the elastically deformable levers 14. As can be taken for example from FIGS. 6A, 6B, and 7 the elastically deformable levers 14 guide the floating bearing 12 on a circular path if the floating bearing 12 is laterally deflected upon rotation of eccentric pin 13 which is coupled with motor 1.

A sealing 15 is provided between the intermediate shaft 5 and the bearing insert 4.

The function of the electrically driven device will be explained in more detail below. In use, the motor 1 is activated such that the drive shaft 2 rotates about the first rotary axis I. Consequently, drive pin 3 rotates about the first rotary axis I, too. Rotation of the drive pin 3 results in a lateral displacement of the floating bearing 12 such that the floating bearing 12 pivots guided by elastically deformable levers 14. This movement of the floating bearing 12 generated by the eccentric drive pin 3 is a sinusoidal movement. This sinusoidal movement of the floating bearing 12 is transmitted to the intermediate shaft 5 by means of the crank arm 11. Thus, the intermediate shaft 5 performs a reciprocating pivoting which is transmitted via the bridge 7 to the driven shafts 8. The rotation of the driven shafts 8 about the intermediate shaft 5 is close to a linear reciprocating movement which may be transmitted to cutter units of a shaver.

Figure 6A:
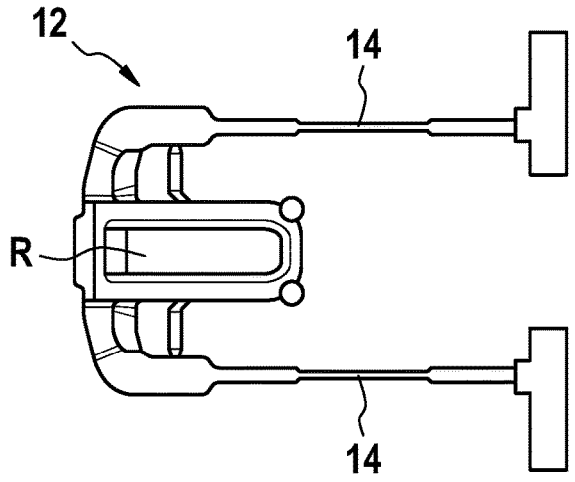
FIG. 6A shows a view of component parts of the device of FIG. 1 in the neutral position.
Figure 6B:
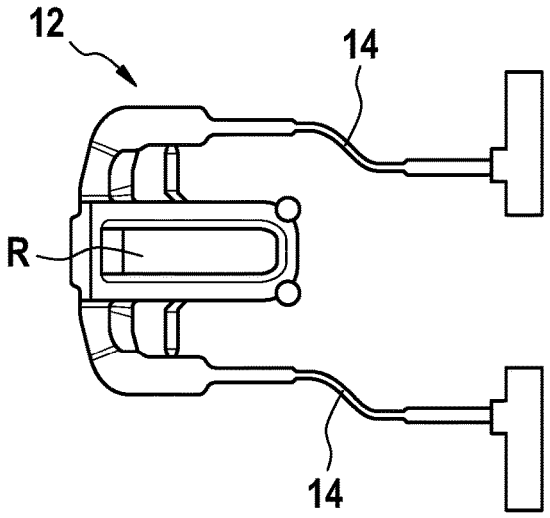
FIG. 6B shows a view of component parts of the device of FIG. 1 in a deflected position.
Figure 7:
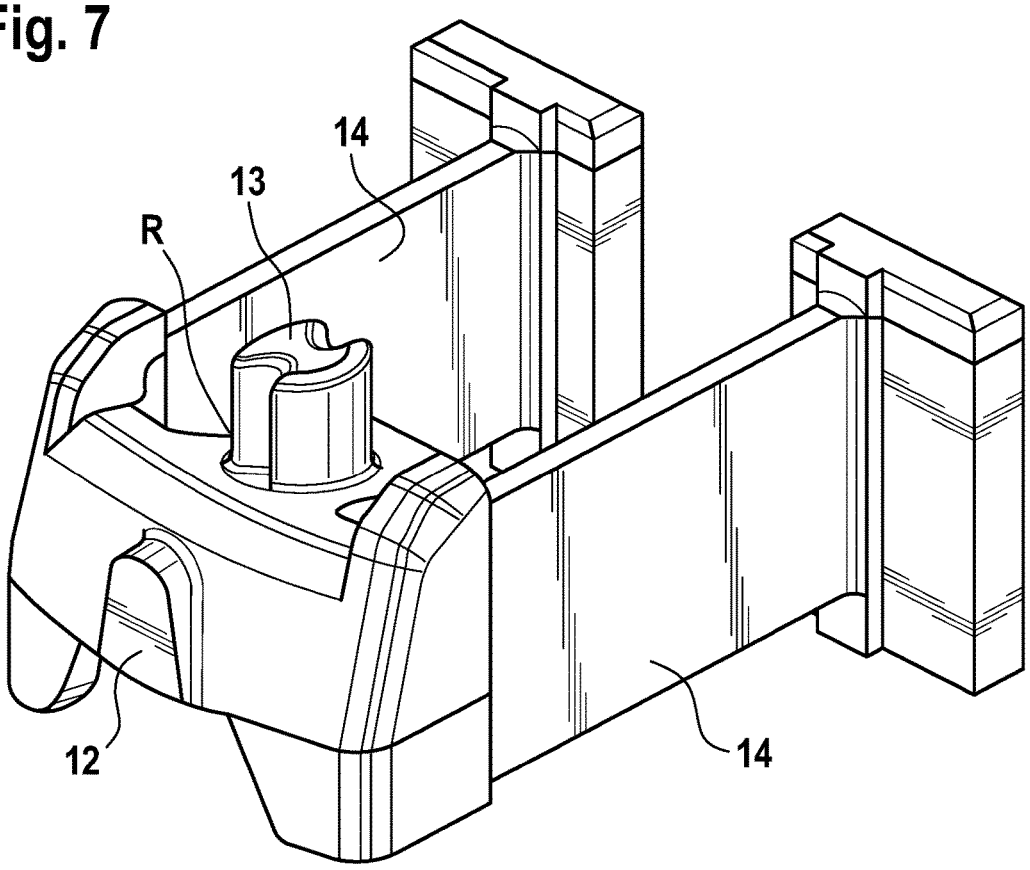
FIG. 7 shows a further perspective view of component parts of the device of FIG. 1.

FIG. 6A shows the floating bearing 12 with the elastically deformable levers 14 in an unstressed home position or neutral position, whereas FIG. 6B shows the floating bearing 12 deflected from the neutral or center position. This neutral position is a position in which the drive pin 3 extends in a plane spanned by the third rotary axis III (longitudinal axis) of the intermediate shaft 5, e.g. the sectional plane defining the sectional view of FIG. 3. In this neutral position, the drive pin 3 typically is in one of its turning points within the floating bearing. This position typically corresponds to the middle of the reciprocating movement of the intermediate shaft in either direction.

As the floating bearing 12 is guided with respect to the housing by means of elastically deformable levers 14, lateral displacement of the floating bearing 12 in one direction stores energy within the elastically deformable levers 14 which is released from the elastically deformable levers 14 upon lateral movement of the floating bearing 12 in the opposite direction until the floating bearing 12 reaches of the unstressed home position. Periodically storing and releasing energy upon rotation of the eccentric drive pin 3 results in decelerating and accelerating the driven shafts 8. In more detail, the substantially linear movement of a driven shaft 8 is decelerated by the bias of the elastically deformable levers 14 as of the driven shaft 8 approaches the turning point of the substantially linear movement. On the other hand, the substantially linear movement of the driven shaft 8 is accelerated by the bias of the elastically deformable levers 14 at or shortly after the turning point, i.e. with the driven shaft 8 moving in the opposite direction.

The design of the gear mechanism with the floating bearing 12 guided by the elastically deformable levers 14 provides for a further advantage compared with a simplified mechanism which couples the intermediate shaft 5 to the drive pin 3 only by means of a crank arm. In such a simplified mechanism, continuous rotation of the drive pin 3 would not generate a perfectly sinusoidal reciprocating pivoting of the intermediate shaft 5 about its rotary axis III. In more detail, given that the crank arm would change its direction of movement caused by the drive pin 3 at positions of the drive pin 3 which are not exactly 180° spaced from each other, the crank arm would move faster in one direction compared to the opposite direction. However, with the gear mechanism according to the present disclosure having the floating bearing 12 guided by the elastically deformable levers 14 and the crank arm 11 translating this movement of the floating bearing 12 to the intermediate shaft 5, the movement of the crank arm 11 changes the direction of the reciprocating movement at positions of the drive pin 3 which are at least substantially spaced by 180°. This results in a perfect sinusoidal movement or a movement which is at least close to a perfect sinusoidal movement of the intermediate shaft 5.

Figure 8:
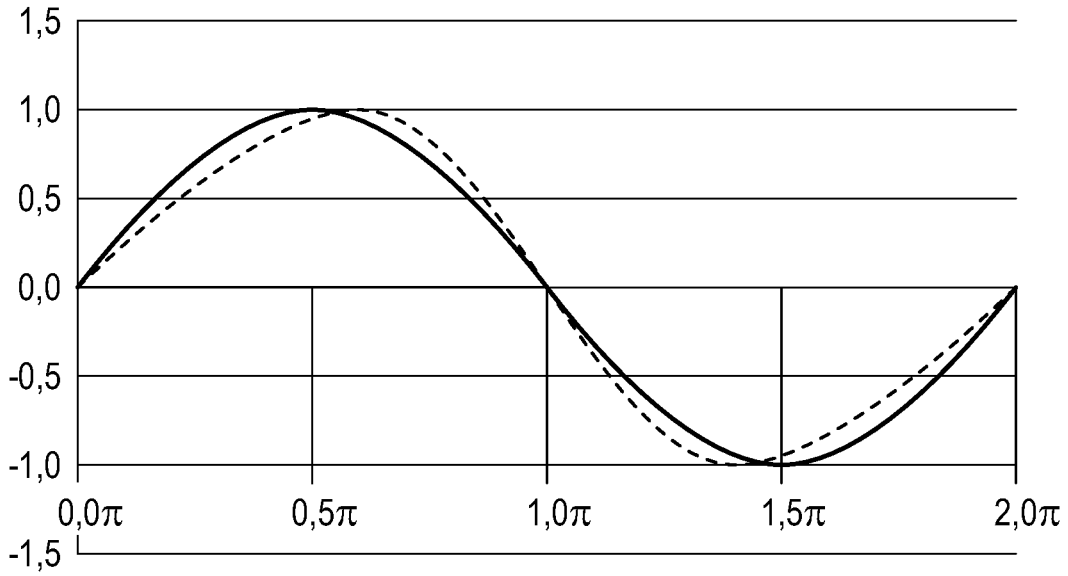
FIG. 8 shows a graph of the linear movement of a cutter block over one rotation of the drive shaft.

FIG. 8 exemplary shows a graph of the displacement (vertical axis) by the linear movement of a cutter block, e.g. the non-foil type cutter unit 24, in mm over one full rotation of the drive shaft 2 over time (horizontal axis). The solid line in FIG. 8 depicts the movements in an electrically driven device according to the invention whereas the dashed line depicts a prior art device. While the solid line corresponds to a perfect sinusoidal behavior, deviations from this perfect sinusoidal movement are shown in the dashed line in that the maximum displacement of the cutter block is slightly offset from the 90° and 270° (i.e. 0,5 $\pi$ and 1,5 $\pi$), respectively. While the derivative of a sinusoidal graph is again a (shifted) sinusoidal graph, deviations from a sinusoidal graph result in increased deviations in the respective derivative. In other words, if the movement departs from a sinusoidal behavior, the acceleration as the second derivative of the displacement further departs from a sinusoidal movement which may over several rotations cause a disadvantageous increase of resulting accelerating forces which may cause unwanted vibrations add up and cause vibrations.

Figure 9:
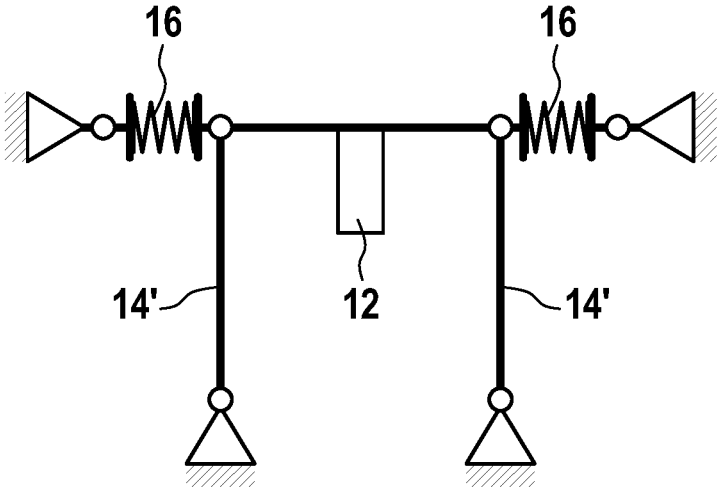
FIG. 9 shows an alternative arrangement of elastically deformable elements.

An alternative embodiment of the electrically driven device is partially depicted in FIG. 9. In this alternative embodiment, the design and arrangement of the elastically deformable element(s) is changed in that the elastically deformable elements are coil springs 16 which are attached to the housing and to the crank arm 11. The floating bearing 12 is guided by two levers 14' in a similar way as explained above with respect to the first embodiment. As a further alternative, the coil springs 16 may be attached to the floating bearing 12, to the bridge 7, to a lever 14' or to a lever (not shown) attached to the intermediate shaft 5. While FIG. 9 shows an embodiment with two coil springs 16, one single spring 16 or more than two springs may be provided. Still further, the coil spring(s) 16 may be replaced by at least one torsion spring (not shown) acting on the intermediate shaft 5.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrically driven shaving device comprising a housing, an electric motor mounted in the housing and comprising a drive shaft having a first rotary axis, a drive pin connected to the drive shaft eccentrically with respect to the rotary axis such that the drive pin rotates eccentrically, and at least one driven shaft having a second axis and mounted for performing a reciprocating motion relative to the housing, and being adapted to drive a cutter element, wherein the at least one driven shaft is indirectly coupled to the drive shaft by the drive pin and a gear mechanism converting a rotary motion of the drive shaft into the reciprocating motion of the at least one driven shaft, wherein the gear mechanism comprises a floating bearing coupled to the drive pin, one intermediate shaft pivotably mounted in the housing, at least one elastically deformable element coupled to the housing and to the floating bearing, and a crank arm having an end near the intermediate shaft and spaced away from the first rotary axis, the crank arm coupling the intermediate shaft to the floating bearing thereby converting the rotary motion of the drive shaft via the drive pin causing movement of the floating bearing such that the crank arm translates the movement of the floating bearing into an oscillating rotating movement of the intermediate shaft about a third rotary axis which extends in the longitudinal direction of the intermediate shaft, wherein the third rotary axis is inclined with respect to the first rotary axis and the intermediate shaft is coupled to the at least one driven shaft by a pivotable bridge such that the intermediate shaft is offset with respect to the at least one driven shaft.

2. The electrically driven shaving device according to claim 1, wherein the at least one elastically deformable element is arranged such that the floating bearing is biased by the at least one elastically deformable element into a neutral position which is defined by the intermediate shaft and the drive pin being located in a common plane.

3. The electrically driven shaving device according to claim 1, wherein the at least one elastically deformable element comprises at least one leaf spring.

4. The electrically driven shaving device according to claim 3, wherein the at least one leaf spring comprises at least one tapered section with a reduced bending stiffness.

5. The electrically driven shaving device according to claim 1, wherein the at least one elastically deformable element comprises at least one compression spring or tension spring.

6. The electrically driven shaving device according to claim 1, wherein the at least one elastically deformable element forms a unitary component part with the floating bearing.

7. The electrically driven shaving device according to claim 6, wherein the floating bearing comprises a slotted hole to engage the drive pin provided in a central portion bridging two elastically deformable levers of the at least one elastically deformable element.

8. The electrically driven shaving device according to claim 1, wherein the crank arm is rotationally and axially constrained to the intermediate shaft.

9. The electrically driven shaving device according to claim 1, wherein the intermediate shaft is rotationally and axially constrained to the pivotable bridge.

10. The electrically driven shaving device according to claim 1, wherein the intermediate shaft is externally guided in the housing by at least one bearing sleeve.

11. The electrically driven shaving device according to claim 1, wherein the crank arm is coupled to the floating bearing by a pin of the floating bearing engaging a recess or slotted hole of the crank arm.

12. The electrically driven shaving device according to claim 1, wherein the second axis is inclined with respect to the first rotary axis.

13. The electrically driven shaving device according to claim 1, wherein the pivotable bridge is rotationally constrained to the at least one driven shaft.

14. The electrically driven shaving device according to claim 1, wherein the housing comprises a bearing insert with the intermediate shaft extending through the bearing insert.

15. The electrically driven shaving device according to claim 1, wherein the housing comprises a shaver body, a neck portion and a shaver head, wherein the electric motor, the drive shaft, the drive pin, the crank arm, the at least one elastically deformable element and the floating bearing are located in the shaver body, wherein the at least one driven shaft and the pivotable bridge are located in the shaver head and wherein the intermediate shaft extends through the neck portion, partially in the shaver body and partially in the shaver head.

16. The electrically driven shaving device according to claim 15, wherein the at least one driven shaft is coupled to a non-foil type cutter element which is guided in the shaver head permitting a linear translational movement of the non-foil type cutter element within the shaver head.

17. The electrically driven shaving device according to claim 1, wherein the drive pin and the gear mechanism convert the rotary motion of the drive shaft into an at least substantially sinusoidal reciprocating displacement of the at least one driven shaft.

18. The electrically driven shaving device according to claim 1, wherein the at least one driven shaft comprises first and second driven shafts, each being coupled to a cutter element which is guided in a shaver head permitting a linear translational movement of the cutter element within the shaver head.

19. The electrically driven shaving device according to claim 1, wherein the coupling between the intermediate shaft and the at least one driven shaft by the pivotable bridge is such that the intermediate shaft drives an oscillating rotating movement of the pivotable bridge about the third rotary axis to produce the reciprocating motion relative to the housing of the at least one driven shaft.

20. An electrically driven shaving device comprising:

a housing, an electric motor mounted in the housing and comprising a drive shaft having a first rotary axis, a drive pin connected to the drive shaft eccentrically with respect to the rotary axis such that the drive pin rotates eccentrically, and at least one driven shaft having a second axis and mounted for performing a reciprocating motion relative to the housing; and being adapted to drive a cutter element, wherein the at least one driven shaft is indirectly coupled to the drive shaft by the drive pin and a gear mechanism converting a rotary motion of the drive shaft into the reciprocating motion of the at least one driven shaft, wherein the gear mechanism comprises a floating bearing coupled to the drive pin, one intermediate shaft pivotably mounted in the housing, at least one elastically deformable element coupled to the housing at a location spaced away from the motor and to the floating bearing, and a crank arm having an end near the intermediate shaft and spaced away from the first rotary axis, the crank arm coupling the intermediate shaft to the floating bearing thereby converting the rotary motion of the drive shaft via the drive pin causing movement of the floating bearing such that the crank arm translates the movement of the floating bearing into an oscillating rotating movement of the intermediate shaft about a third rotary axis which extends in the longitudinal direction of the intermediate shaft, wherein the intermediate shaft is coupled to the at least one driven shaft by a pivotable bridge such that the intermediate shaft is offset with respect to the at least one driven shaft.

21. The electrically driven shaving device of claim 20, wherein the at least one elastically deformable element has a central axis extending from where the at least one deformable element is coupled to the housing to where the at least one deformable element is coupled to the floating bearing, wherein the central axis is substantially perpendicular to the first rotary axis.

22. An electrically driven shaving device comprising:

a housing, an electric motor mounted in the housing and comprising a drive shaft having a first rotary axis, a drive pin connected to the drive shaft eccentrically with respect to the rotary axis such that the drive pin rotates eccentrically, and at least one driven shaft having a second axis and mounted for performing a reciprocating motion relative to the housing, and being adapted to drive a clutter element, wherein the at least one driven shaft is indirectly coupled to the drive shaft by the drive pin and a gear mechanism converting a rotary motion of the drive shaft into the reciprocating motion of the at least one driven shaft, wherein the gear mechanism comprises a floating bearing coupled to the drive pin, one intermediate shaft pivotably mounted in the housing, at least one elastically deformable element coupled to the housing and to the floating bearing, and a crank arm having an end near the intermediate shaft and spaced away from the first rotary axis, the crank arm coupling the intermediate shaft to the floating bearing thereby converting the rotary motion of the drive shaft via the drive pin causing movement of the floating bearing such that the crank arm translates the movement of the floating bearing into an oscillating rotating movement of the intermediate shaft about a third rotary axis which extends in the longitudinal direction of the intermediate shaft, wherein the intermediate shaft is coupled to the at least one driven shaft by a pivotable bridge such that the intermediate shaft is offset with respect to the at least one driven shaft.

* * * * *